US008092166B2

(12) United States Patent
Nicolas et al.

(10) Patent No.: US 8,092,166 B2
(45) Date of Patent: Jan. 10, 2012

(54) FAN

(75) Inventors: Frederic Nicolas, Malmesbury (GB); Kevin John Simmonds, Malmesbury (GB)

(73) Assignee: Dyson Technology Limited, Malmesbury (GB)

( * ) Notice: Subject to any disclaimer, the term of this patent is extended or adjusted under 35 U.S.C. 154(b) by 38 days.

(21) Appl. No.: 12/622,844

(22) Filed: Nov. 20, 2009

(65) Prior Publication Data

US 2010/0150699 A1 Jun. 17, 2010

(30) Foreign Application Priority Data

Dec. 11, 2008 (GB) ..... 0822612.8

(51) Int. Cl.
*F04D 29/44* (2006.01)
*F04D 29/54* (2006.01)

(52) U.S. Cl. ..... 415/209.2; 415/209.4; 415/211.2; 415/220; 415/223; 415/225; 415/226; 415/914; 239/419.5; 239/590; 239/590.5; 239/597; 239/598; 239/DIG. 7

(58) Field of Classification Search ..... 415/185, 415/191, 208.1, 208.2, 210.1, 211.2, 220, 415/222, 223, 225, 226, 209.2, 209.3, 914, 415/189, 190, 209.4; 239/419.5, 590, 590.5, 239/597, 598, DIG. 7
See application file for complete search history.

(56) References Cited

U.S. PATENT DOCUMENTS 1,767,060 A 6/1930 Ferguson
1,896,869 A 2/1933 Larsh
2,014,185 A 9/1935 Martin
D103,476 S 3/1937 Weber
2,115,883 A 5/1938 Sher
D115,344 S 6/1939 Chapman
2,210,458 A 8/1940 Keilholtz
2,336,295 A 12/1943 Reimuller
2,433,795 A 12/1947 Stokes
2,473,325 A 6/1949 Aufiero
2,476,002 A * 7/1949 Stalker ..... 415/914

(Continued)

FOREIGN PATENT DOCUMENTS

BE 560119 8/1957

(Continued)

OTHER PUBLICATIONS

International Search Report and Written Opinion mailed Jan. 14, 2010, directed to counterpart International Application No. PCT/GB2009/051497; 12 pages.

(Continued)

*Primary Examiner* — Christopher Verdier
(74) *Attorney, Agent, or Firm* — Morrison & Foerster LLP

(57) ABSTRACT

A fan assembly for creating an air current is described. The fan assembly includes a nozzle mounted on a base housing a device for creating an air flow through the nozzle. The nozzle includes an interior passage for receiving the air flow from the base, a mouth through which the air flow is emitted, the mouth being defined by facing surfaces of the nozzle, and spacers for spacing apart the facing surfaces of the nozzle. The nozzle extends substantially orthogonally about an axis to define an opening through which air from outside the fan assembly is drawn by the air flow emitted from the mouth. The fan provides an arrangement producing an air current and a flow of cooling air created without requiring a bladed fan. The spacers can provide for a reliable, reproducible nozzle of the fan assembly and performance of the fan assembly.

26 Claims, 6 Drawing Sheets

U.S. PATENT DOCUMENTS

| | | | | |
|---|---|---|---|---|
| 2,488,467 | A | | 11/1949 | De Lisio |
| 2,510,132 | A | | 6/1950 | Morrison |
| 2,544,379 | A | | 3/1951 | Davenport |
| 2,547,448 | A | | 4/1951 | Demuth |
| 2,583,374 | A | | 1/1952 | Hoffman |
| 2,620,127 | A | | 12/1952 | Radcliffe |
| 2,808,198 | A | | 10/1957 | Morrison |
| 2,830,779 | A | | 4/1958 | Wentling |
| 2,838,229 | A | | 6/1958 | Belanger |
| 2,922,570 | A | | 1/1960 | Allen |
| 3,047,208 | A | | 7/1962 | Coanda |
| 3,270,655 | A | | 9/1966 | Guirl et al. |
| D206,973 | S | | 2/1967 | De Lisio |
| 3,503,138 | A | | 3/1970 | Fuchs et al. |
| 3,724,092 | A | | 4/1973 | McCleerey |
| 3,743,186 | A | | 7/1973 | Mocarski |
| 3,795,367 | A | | 3/1974 | Mocarski |
| 3,875,745 | A | | 4/1975 | Franklin |
| 3,885,891 | A | | 5/1975 | Throndson |
| 3,943,329 | A | | 3/1976 | Hlavac |
| 4,037,991 | A | | 7/1977 | Taylor |
| 4,046,492 | A | | 9/1977 | Inglis |
| 4,073,613 | A | * | 2/1978 | Desty ..... 239/DIG. 7 |
| 4,192,461 | A | | 3/1980 | Arborg |
| 4,336,017 | A | | 6/1982 | Desty |
| 4,342,204 | A | | 8/1982 | Melikian et al. |
| 4,448,354 | A | * | 5/1984 | Reznick et al. ..... 239/DIG. 7 |
| 4,643,351 | A | | 2/1987 | Fukamachi et al. |
| 4,718,870 | A | | 1/1988 | Watts |
| 4,732,539 | A | | 3/1988 | Shin-Chin |
| 4,790,133 | A | | 12/1988 | Stuart |
| 5,061,405 | A | | 10/1991 | Stanek et al. |
| 5,168,722 | A | | 12/1992 | Brock |
| 5,188,508 | A | | 2/1993 | Scott et al. |
| 5,402,938 | A | | 4/1995 | Sweeney |
| 5,425,902 | A | | 6/1995 | Miller et al. |
| 5,609,473 | A | | 3/1997 | Litvin |
| 5,649,370 | A | | 7/1997 | Russo |
| 5,735,683 | A | * | 4/1998 | Muschelknautz ..... 239/419.5 |
| 5,762,034 | A | * | 6/1998 | Foss ..... 123/41.49 |
| 5,881,685 | A | | 3/1999 | Foss et al. |
| D415,271 | S | | 10/1999 | Feer |
| 6,015,274 | A | | 1/2000 | Bias et al. |
| 6,073,881 | A | | 6/2000 | Chen |
| D429,808 | S | | 8/2000 | Krauss et al. |
| 6,123,618 | A | | 9/2000 | Day |
| D435,899 | S | | 1/2001 | Melwani |
| 6,254,337 | B1 | | 7/2001 | Arnold |
| 6,269,549 | B1 | | 8/2001 | Carlucci et al. |
| 6,282,746 | B1 | | 9/2001 | Schleeter |
| 6,293,121 | B1 | | 9/2001 | Labrador |
| 6,386,845 | B1 | | 5/2002 | Bedard |
| 6,480,672 | B1 | | 11/2002 | Rosenzweig et al. |
| D485,895 | S | | 1/2004 | Melwani |
| 7,147,336 | B1 | | 12/2006 | Chou |
| D539,414 | S | | 3/2007 | Russak et al. |
| D598,532 | S | | 8/2009 | Dyson et al. |
| D602,143 | S | | 10/2009 | Gammack et al. |
| D602,144 | S | | 10/2009 | Dyson et al. |
| D605,748 | S | | 12/2009 | Gammack et al. |
| 7,664,377 | B2 | | 2/2010 | Liao |
| D614,280 | S | | 4/2010 | Dyson et al. |
| 2003/0059307 | A1 | | 3/2003 | Moreno et al. |
| 2003/0171093 | A1 | | 9/2003 | Gumucio Del Pozo |
| 2004/0022631 | A1 | | 2/2004 | Birdsell et al. |
| 2004/0049842 | A1 | | 3/2004 | Prehodka |
| 2004/0149881 | A1 | | 8/2004 | Allen |
| 2005/0031448 | A1 | | 2/2005 | Lasko et al. |
| 2005/0053465 | A1 | | 3/2005 | Roach et al. |
| 2005/0069407 | A1 | | 3/2005 | Winkler et al. |
| 2006/0199515 | A1 | | 9/2006 | Lasko et al. |
| 2007/0166160 | A1 | | 7/2007 | Russak et al. |
| 2008/0166224 | A1 | | 7/2008 | Giffin |
| 2008/0286130 | A1 | | 11/2008 | Purvines |
| 2009/0026850 | A1 | | 1/2009 | Fu |
| 2009/0039805 | A1 | | 2/2009 | Tang |
| 2009/0060710 | A1 | | 3/2009 | Gammack et al. |
| 2009/0060711 | A1 | | 3/2009 | Gammack et al. |
| 2009/0191054 | A1 | | 7/2009 | Winkler |
| 2009/0214341 | A1 | | 8/2009 | Craig |
| 2010/0225012 | A1 | | 9/2010 | Fitton et al. |
| 2010/0226749 | A1 | | 9/2010 | Gammack et al. |
| 2010/0226750 | A1 | | 9/2010 | Gammack |
| 2010/0226751 | A1 | | 9/2010 | Gammack et al. |
| 2010/0226752 | A1 | | 9/2010 | Gammack et al. |
| 2010/0226753 | A1 | | 9/2010 | Dyson et al. |
| 2010/0226754 | A1 | | 9/2010 | Hutton et al. |
| 2010/0226758 | A1 | | 9/2010 | Cookson et al. |
| 2010/0226763 | A1 | | 9/2010 | Gammack et al. |
| 2010/0226764 | A1 | | 9/2010 | Gammack et al. |
| 2010/0226769 | A1 | | 9/2010 | Helps |
| 2010/0226771 | A1 | | 9/2010 | Crawford et al. |
| 2010/0226787 | A1 | | 9/2010 | Gammack et al. |
| 2010/0226797 | A1 | | 9/2010 | Fitton et al. |
| 2010/0226801 | A1 | | 9/2010 | Gammack |
| 2010/0254800 | A1 | | 10/2010 | Fitton et al. |
| 2011/0164959 | A1 | | 7/2011 | Fitton et al. |

FOREIGN PATENT DOCUMENTS

| | | | |
|---|---|---|---|
| CN | 2111392 | | 7/1992 |
| CN | 201349269 | | 11/2009 |
| DE | 27 48 724 | | 5/1978 |
| DE | 3644567 | | 7/1988 |
| DE | 19510397 | | 9/1996 |
| EP | 1 138 954 | | 10/2001 |
| EP | 1 939 456 | | 7/2008 |
| EP | 1 980 432 | | 10/2008 |
| EP | 2 000 675 | | 12/2008 |
| FR | 2794195 | | 12/2000 |
| GB | 22235 | | 6/1914 |
| GB | 383498 | | 11/1932 |
| GB | 593828 | | 10/1947 |
| GB | 633273 | | 12/1949 |
| GB | 641622 | | 8/1950 |
| GB | 661747 | | 11/1951 |
| GB | 863 124 | | 3/1961 |
| GB | 1067956 | | 5/1967 |
| GB | 1262131 | | 2/1972 |
| GB | 1265341 | | 3/1972 |
| GB | 1 278 606 | | 6/1972 |
| GB | 1 304 560 | | 1/1973 |
| GB | 1 403 188 | | 8/1975 |
| GB | 1 434 226 | | 5/1976 |
| GB | 1501473 | | 2/1978 |
| GB | 2 107 787 | | 5/1983 |
| GB | 2 111 125 | | 6/1983 |
| GB | 2 178 256 | | 2/1987 |
| GB | 2 185 533 | | 7/1987 |
| GB | 2185531 | | 7/1987 |
| GB | 2 218 196 | | 11/1989 |
| GB | 2236804 | | 4/1991 |
| GB | 2242935 | | 10/1991 |
| GB | 2 285 504 | | 7/1995 |
| GB | 2 428 569 | | 2/2007 |
| GB | 2 452 593 | | 3/2009 |
| GB | 2452490 | | 3/2009 |
| GB | 2468369 | | 8/2010 |
| JP | 56-167897 | | 12/1981 |
| JP | 57-157097 | | 9/1982 |
| JP | 61-31830 | | 2/1986 |
| JP | 61-116093 | | 6/1986 |
| JP | 63-179198 | | 7/1988 |
| JP | 64-21300 | U | 2/1989 |
| JP | 1-138399 | | 5/1989 |
| JP | 2-218890 | | 8/1990 |
| JP | 4-43895 | | 2/1992 |
| JP | 4-366330 | | 12/1992 |
| JP | 5-157093 | | 6/1993 |
| JP | 5-263786 | | 10/1993 |
| JP | 6-74190 | | 3/1994 |
| JP | 6-147188 | | 5/1994 |
| JP | 6-257591 | | 9/1994 |
| JP | 7-190443 | | 7/1995 |
| JP | 9-100800 | | 4/1997 |
| JP | 2000-116179 | | 4/2000 |
| JP | 2000-201723 | | 7/2000 |
| JP | 2001-17358 | | 1/2001 |

| | | |
|---|---|---|
| JP | 2002-21797 | 1/2002 |
| JP | 2004-208935 | 7/2004 |
| JP | 2004-216221 | 8/2004 |
| JP | 2005-307985 | 11/2005 |
| JP | 2007-138763 | 6/2007 |
| JP | 2007-138789 | 6/2007 |
| JP | 2008-100204 | 5/2008 |
| JP | 2009-44568 | 2/2009 |
| WO | WO 90/13478 | 11/1990 |
| WO | WO-02/073096 | 9/2002 |
| WO | WO 03/058795 | 7/2003 |
| WO | WO-2005/050026 | 6/2005 |
| WO | WO 2005/057091 | 6/2005 |
| WO | WO 2007/024955 | 3/2007 |
| WO | WO 2007/048205 | 5/2007 |
| WO | WO 2008/014641 | 2/2008 |
| WO | WO-2008/024569 | 2/2008 |
| WO | WO-2009/030879 | 3/2009 |
| WO | WO-2009/030881 | 3/2009 |
| WO | WO-2010/100452 | 9/2010 |
| WO | WO-2010/100453 | 9/2010 |

OTHER PUBLICATIONS

Reba, I. (1966).“Applications of the Coanda Effect,” Scientific American 214:84-92.
GB Search report, mailed Apr. 7, 2009, directed at counterpart application No. GB0822612.8, 1 page.
Simmonds, K. J. et al. U.S. Appl. No. 13/125,742, filed Apr. 22, 2011; 20 pages.
Fitton, N.G. et al., U.S. Office Action mailed Mar. 8, 2011, directed to U.S. Appl. No. 12/716,780; 12 pages.
Gammack et al., U.S. Appl. No. 12/945,558, filed Nov. 12, 2010; 23 pages.
Gammack et al., U.S. Appl. No. 12/917,247, filed Nov. 1, 2010; 40 pages.
Fitton et al., U.S. Office Action mailed Nov. 30, 2010 directed to U.S. Appl. No. 12/560,232; 9 pages.
Gammack, P. et al., U.S. Office Action mailed Dec. 9, 2010, directed to U.S. Appl. No. 12/203,698; 10 pages.
Gammack, P. et al., U.S. Office Action mailed Dec. 9, 2010, directed to U.S. Appl. No. 12/716,781; 17 pages.
Gammack, P. et al., U.S. Office Action mailed Dec. 10, 2010, directed to U.S. Appl. No. 12/230,613; 12 pages.
Gammack, P. et al. U.S. Office Action mailed May 13, 2011, directed to U.S. Appl. No. 12/230,613; 13 pages.
Third Party Submission Under 37 CFR 1.99 filed Jun. 2, 2011, directed towards U.S. Appl. No. 12/203,698; 3 pages.
Gammack, P. et al., U.S. Office Action mailed Jun. 21, 2011, directed to U.S. Appl. No. 12/203,698; 11 pages.
Gammack, P. et al., U.S. Office Action mailed Jun. 24, 2011, directed to U.S. Appl. No. 12/716,781; 19 pages.

* cited by examiner

FAN

REFERENCE TO RELATED APPLICATIONS

This application claims the priority of United Kingdom Application No. 0822612.8, filed Dec. 11, 2008, the entire contents of which are incorporated herein by reference.

FIELD OF THE INVENTION

The present invention relates to a fan appliance. Particularly, but not exclusively, the present invention relates to a domestic fan, such as a desk fan, for creating air circulation and air current in a room, in an office or other domestic environment.

BACKGROUND OF THE INVENTION

A number of types of domestic fan are known. It is common for a conventional fan to include a single set of blades or vanes mounted for rotation about an axis, and driving apparatus mounted about the axis for rotating the set of blades. Domestic fans are available in a variety of sizes and diameters, for example, a ceiling fan can be at least 1 m in diameter and is usually mounted in a suspended manner from the ceiling and positioned to provide a downward flow of air and cooling throughout a room.

Desk fans, on the other hand, are often around 30 cm in diameter and are usually free standing and portable. In standard desk fan arrangements the single set of blades is positioned close to the user and the rotation of the fan blades provides a forward flow of air current in a room or into a part of a room, and towards the user. Other types of fan can be attached to the floor or mounted on a wall. The movement and circulation of the air creates a so called 'wind chill' or breeze and, as a result, the user experiences a cooling effect as heat is dissipated through convection and evaporation. Fans such as that disclosed in U.S. D Pat. No. 103,476 and U.S. Pat. No. 1,767,060 are suitable for standing on a desk or a table. U.S. Pat. No. 1,767,060 describes a desk fan with an oscillating function that aims to provide an air circulation equivalent to two or more prior art fans.

A disadvantage of this type of arrangement is that the forward flow of air current produced by the rotating blades of the fan is not felt uniformly by the user. This is due to variations across the blade surface or across the outward facing surface of the fan. Uneven or 'choppy' air flow can be felt as a series of pulses or blasts of air and can be noisy. Variations across the blade surface, or across other fan surfaces, can vary from product to product and may even vary from one individual fan machine to another.

In a domestic environment it is desirable for appliances to be as small and compact as possible due to space restrictions. It is undesirable for parts to project from the appliance, or for the user to be able to touch any moving parts of the fan, such as the blades. Some arrangements have safety features such as a cage or shroud around the blades to protect a user from injuring himself on the moving parts of the fan. U.S. D Pat. No. 103,476 shows a type of cage around the blades however, caged blade parts can be difficult to clean.

Other types of fan or circulator are described in U.S. Pat. No. 2,488,467, U.S. Pat. No. 2,433,795 and JP 56-167897. The fan of U.S. Pat. No. 2,433,795 has spiral slots in a rotating shroud instead of fan blades. The circulator fan disclosed in U.S. Pat. No. 2,488,467 emits air flow from a series of nozzles and has a large base including a motor and a blower or fan for creating the air flow.

Locating fans such as those described above close to a user is not always possible as the bulky shape and structure mean that the fan occupies a significant amount of the user's work space area. In the particular case of a fan placed on, or close to, a desk the fan body or base reduces the area available for paperwork, a computer or other office equipment. Often multiple appliances must be located in the same area, close to a power supply point, and in close proximity to other appliances for ease of connection and in order to reduce the operating costs.

The shape and structure of a fan at a desk not only reduces the working area available to a user but can block natural light (or light from artificial sources) from reaching the desk area. A well lit desk area is desirable for close work and for reading. In addition, a well lit area can reduce eye strain and the related health problems that may result from prolonged periods working in reduced light levels.

SUMMARY OF THE INVENTION

A first aspect of the present invention provides a bladeless fan assembly for creating an air current, the fan assembly comprising a nozzle, a device for creating an air flow through the nozzle, the nozzle comprising an interior passage for receiving the air flow, a mouth through which the air flow is emitted, the mouth being defined by facing surfaces of the nozzle, and spacers for spacing apart the facing surfaces of the nozzle, the nozzle defining an opening through which air from outside the fan assembly is drawn by the air flow emitted from the mouth.

Advantageously, by this arrangement an air current is generated and a cooling effect is created without requiring a bladed fan. The air current created by the fan assembly has the benefit of being an air flow with low turbulence and with a more linear air flow profile than that provided by other prior art devices. This can improve the comfort of a user receiving the air flow.

Advantageously, the use of spacers spacing apart the facing surfaces of the nozzle enables a smooth, even output of air flow to be delivered to a user's location without the user feeling a 'choppy' flow. The spacers of the fan assembly provide for reliable, reproducible manufacture of the nozzle of the fan assembly. This means that a user should not experience a variation in the intensity of the air flow over time due to product aging or a variation from one fan assembly to another fan assembly due to variations in manufacture. The invention provides a fan assembly delivering a suitable cooling effect that is directed and focussed as compared to the air flow produced by prior art fans.

In the following description of fans and, in particular a fan of the preferred embodiment, the term 'bladeless' is used to describe apparatus in which air flow is emitted or projected forwards from the fan assembly without the use of blades. By this definition a bladeless fan assembly can be considered to have an output area or emission zone absent blades or vanes from which the air flow is released or emitted in a direction appropriate for the user. A bladeless fan assembly may be supplied with a primary source of air from a variety of sources or devices such as pumps, generators, motors or other fluid transfer devices, which include rotating devices such as a motor rotor and a bladed impeller for generating air flow. The supply of air generated by the motor causes a flow of air to pass from the room space or environment outside the fan assembly through the interior passage to the nozzle and then out through the mouth.

Hence, the description of a fan assembly as bladeless is not intended to extend to the description of the power source and components such as motors that are required for secondary fan functions. Examples of secondary fan functions can include lighting, adjustment and oscillation of the fan.

In a preferred embodiment, the nozzle extends about an axis to define the opening, and the spacers comprise a plurality of spacers angularly spaced about said axis, preferably equally angularly spaced about the axis.

In a preferred embodiment the nozzle extends substantially cylindrically about the axis. This creates a region for guiding and directing the airflow output from all around the opening defined by the nozzle of the fan assembly. In addition the cylindrical arrangement creates an assembly with a nozzle that appears tidy and uniform. An uncluttered design is desirable and appeals to a user or customer. The preferred features and dimensions of the fan assembly result in a compact arrangement while generating a suitable amount of air flow from the fan assembly for cooling a user.

Preferably the nozzle extends by a distance of at least 5 cm in the direction of the axis. Preferably the nozzle extends about the axis by a distance in the range from 30 cm to 180 cm. This provides options for emission of air over a range of different output areas and opening sizes, such as may be suitable for cooling the upper body and face of a user when working at a desk, for example.

The nozzle preferably comprises an inner casing section and an outer casing section which define the interior passage, the mouth and the opening. Each casing section may comprise a plurality of components, but in the preferred embodiment each of these sections is formed from a single annular component.

In the preferred embodiment the spacers are mounted on, preferably integral with, one of the facing surfaces of the nozzle. Advantageously, the integral arrangement of the spacers with this surface can reduce the number of individual parts manufactured, thereby simplifying the process of part manufacture and part assembly, and thereby reducing the cost and complexity of the fan assembly. The spacers are preferably arranged to contact the other one of the facing surfaces.

The spacers are preferably arranged to maintain a set distance between the facing surfaces of the nozzle. This distance is preferably in the range from 0.5 to 5 mm. Preferably, one of the facing surfaces of the nozzle is biased towards the other of the facing surfaces, and so the spacers serve to hold apart the facing surfaces of the nozzle to maintain the set distance therebetween. This can ensure that the spacers engage said other one of the facing surfaces and thus can ensure that the desired spacing between the facing surfaces is achieved. The spacers can be located and orientated in any suitable position that enables the facing surfaces of the nozzle to be spaced apart as desired, without requiring further support or positioning members to set the desired spacing of the facing surfaces. Preferably the spacers comprise a plurality of spacers which are spaced about the opening. With this arrangement each one of the plurality of spacers can engage said other one of the facing surfaces such that a point of contact is provided between each spacer and the said other facing surface. The preferred number of spacers is in the range from 5 to 50.

In the fan assembly of the present invention as previously described, the nozzle may comprise a Coanda surface located adjacent the mouth and over which the mouth is arranged to direct the air flow. A Coanda surface is a known type of surface over which fluid flow exiting an output orifice close to the surface exhibits the Coanda effect. The fluid tends to flow over the surface closely, almost 'clinging to' or 'hugging' the surface. The Coanda effect is already a proven, well documented method of entrainment whereby a primary air flow is directed over the Coanda surface. A description of the features of a Coanda surface, and the effect of fluid flow over a Coanda surface, can be found in articles such as Reba, Scientific American, Volume 214, June 1963 pages 84 to 92. Through use of a Coanda surface, air from outside the fan assembly is drawn through the opening by the air flow directed over the Coanda surface.

In the preferred embodiments an air flow is created through the nozzle of the fan assembly. In the following description this air flow will be referred to as primary air flow. The primary air flow exits the nozzle via the mouth and preferably passes over the Coanda surface. The primary air flow entrains the air surrounding the mouth of the nozzle, which acts as an air amplifier to supply both the primary air flow and the entrained air to the user. The entrained air will be referred to here as a secondary air flow. The secondary air flow is drawn from the room space, region or external environment surrounding the mouth of the nozzle and, by displacement, from other regions around the fan assembly. The primary air flow directed over the Coanda surface combined with the secondary air flow entrained by the air amplifier gives a total air flow emitted or projected forward to a user from the opening defined by the nozzle. The total air flow is sufficient for the fan assembly to create an air current suitable for cooling.

Preferably the nozzle comprises a loop. The shape of the nozzle is not constrained by the requirement to include space for a bladed fan. In a preferred embodiment the nozzle is annular or substantially annular. By providing an annular nozzle the fan can potentially reach a broad area. In a further preferred embodiment the nozzle is at least partially circular. This arrangement can provide a variety of design options for the fan, increasing the choice available to a user or customer. Furthermore, the nozzle can be manufactured as a single piece, reducing the complexity of the fan assembly and thereby reducing manufacturing costs.

In a preferred arrangement the nozzle comprises at least one wall defining the interior passage and the mouth, and the at least one wall comprises the facing surfaces defining the mouth. Preferably, the mouth has an outlet, and the spacing between the facing surfaces at the outlet of the mouth is in the range from 0.5 mm to 10 mm. By this arrangement a nozzle can be provided with the desired flow properties to guide the primary air flow over the surface and provide a relatively uniform, or close to uniform, total air flow reaching the user.

In the preferred fan assembly the device for creating an air flow through the nozzle comprises an impeller driven by a motor. This arrangement provides a fan with efficient air flow generation. More preferably the device for creating an air flow comprises a DC brushless motor and a mixed flow impeller. This can enable frictional losses from motor brushes to be reduced, and can avoid carbon debris from the brushes used in a traditional motor. Reducing carbon debris and emissions is advantageous in a clean or pollutant sensitive environment such as a hospital or around those with allergies. While induction motors, which are generally used in bladed fans, also have no brushes, a DC brushless motor can provide a much wider range of operating speeds than an induction motor.

The device for creating an air flow through the nozzle is preferably located in a base of the fan assembly. The nozzle is preferably mounted on the base.

In a second aspect the present invention provides a nozzle for a fan assembly, preferably a bladeless fan assembly, for creating an air current, the nozzle comprising an interior passage for receiving an air flow, a mouth through which the air flow is emitted, the mouth being defined by facing surfaces of the nozzle, and spacers for spacing apart the facing surfaces of the nozzle, the nozzle defining an opening through which air from outside the fan assembly is drawn by the air flow emitted from the mouth.

Preferably, the nozzle comprises a Coanda surface located adjacent the mouth and over which the mouth is arranged to direct the air flow. In a preferred embodiment the nozzle comprises a diffuser located downstream of the Coanda surface. The diffuser directs the air flow emitted towards a user's location whilst maintaining a smooth, even output, generating a suitable cooling effect without the user feeling a 'choppy' flow.

The invention also provides a fan assembly comprising a nozzle as aforementioned.

The nozzle may be rotatable or pivotable relative to a base portion, or other portion, of the fan assembly. This enables the nozzle to be directed towards or away from a user as required. The fan assembly may be desk, floor, wall or ceiling mountable. This can increase the portion of a room over which the user experiences cooling.

Features described above in connection with the first aspect of the invention are equally applicable to the second aspect of the invention, and vice versa.

BRIEF DESCRIPTION OF THE DRAWINGS

Embodiments of the invention will now be described with reference to the accompanying drawings, in which.

DETAILED DESCRIPTION OF THE INVENTION

Figure 1:
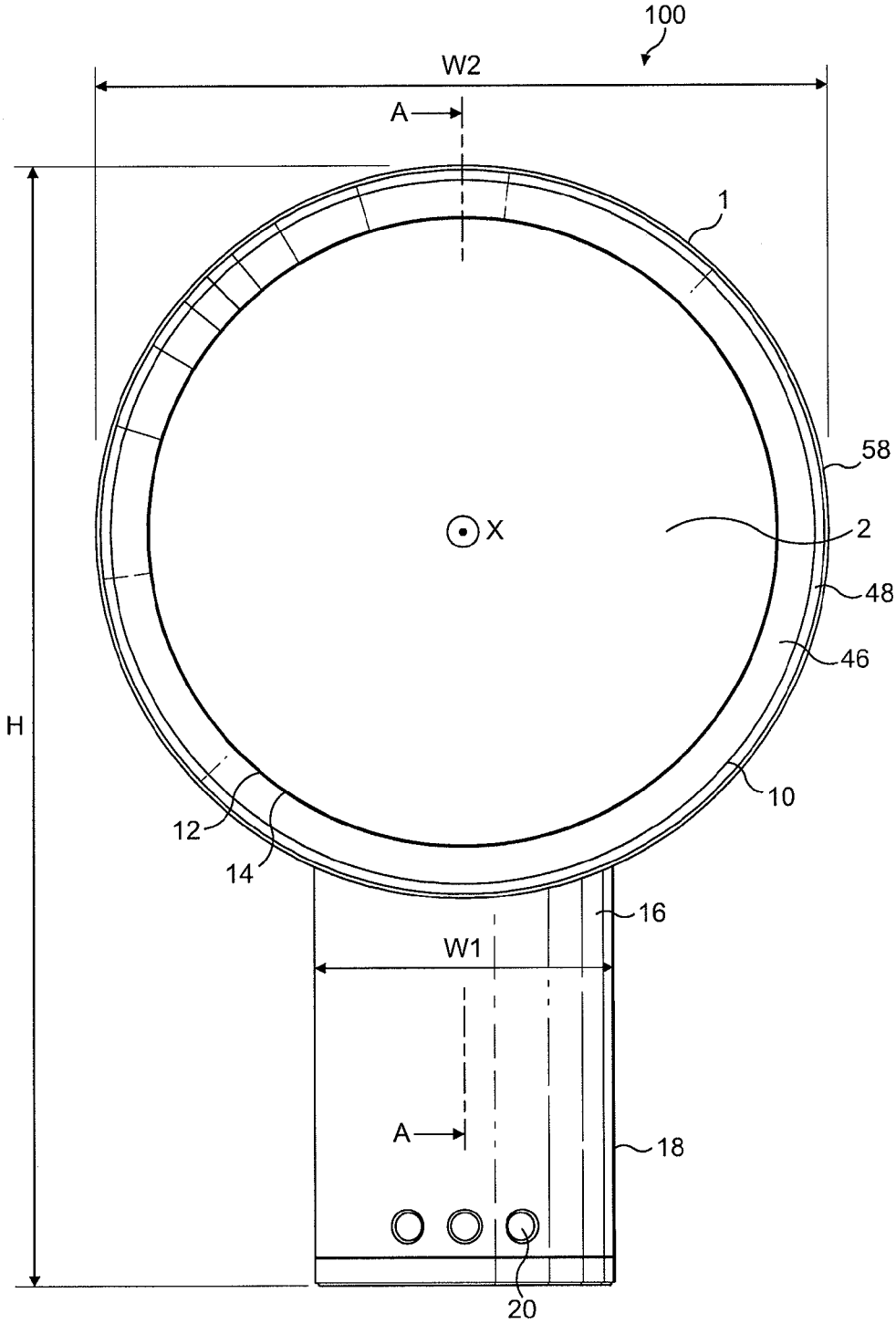
FIG. 1 is a front view of a fan assembly.
Figure 2:
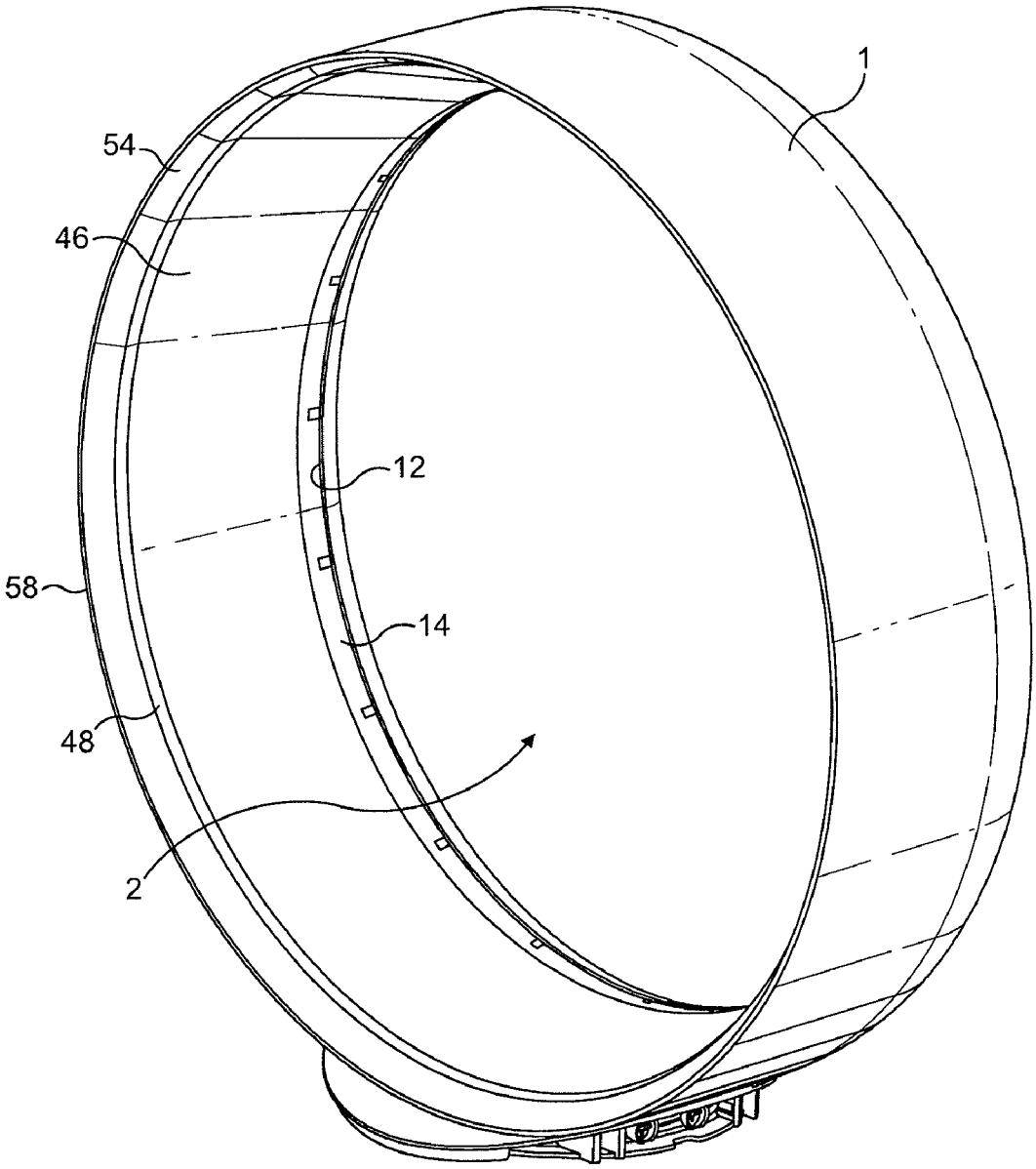
FIG. 2 is a perspective view of a portion of the fan assembly of FIG. 1.
Figure 3:
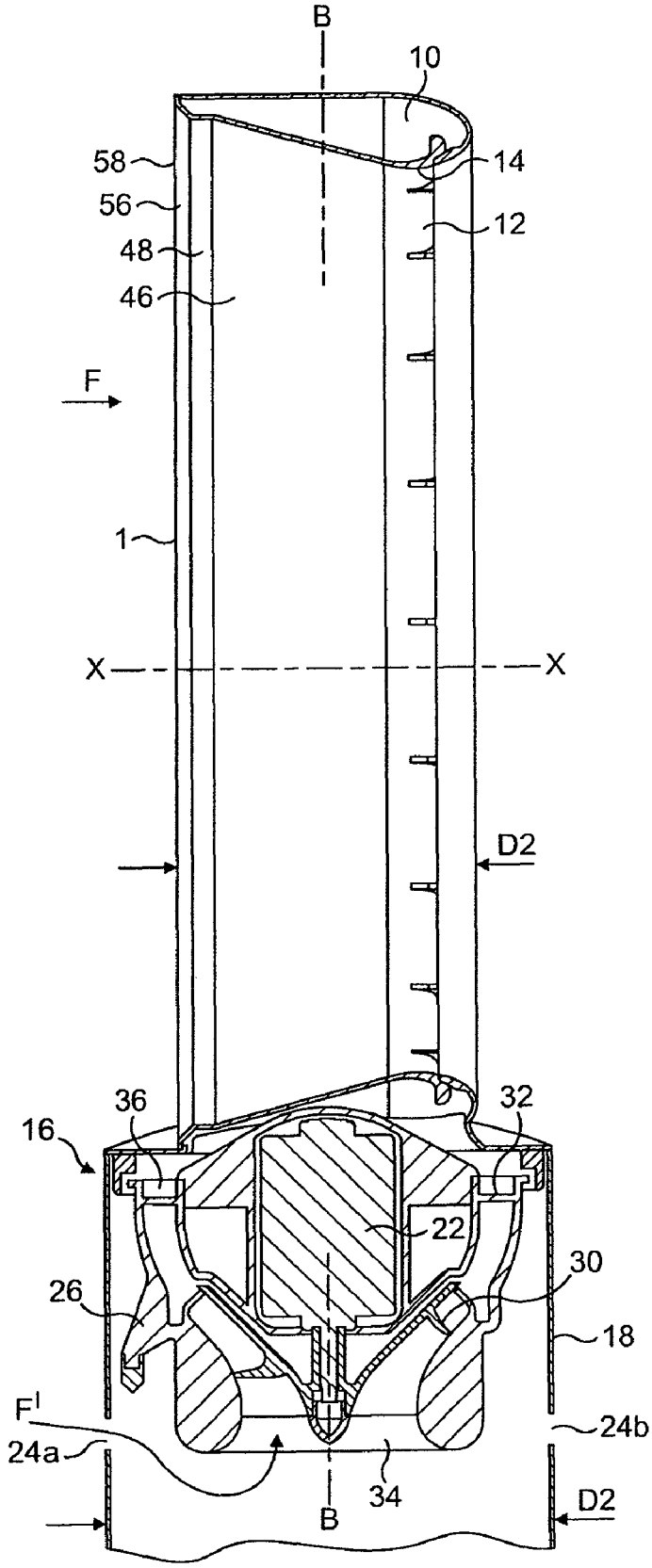
FIG. 3 is a side sectional view through a portion of the fan assembly of FIG. 1 taken at line A-A.

FIG. 1 illustrates an example of a fan assembly 100 viewed from the front of the device. The fan assembly 100 comprises an annular nozzle 1 defining a central opening 2. With reference also to FIGS. 2 and 3, nozzle 1 comprises an interior passage 10, a mouth 12 and a Coanda surface 14 adjacent the mouth 12. The Coanda surface 14 is arranged so that a primary air flow exiting the mouth 12 and directed over the Coanda surface 14 is amplified by the Coanda effect. The nozzle 1 is connected to, and supported by, a base 16 having an outer casing 18. The base 16 includes a plurality of selection buttons 20 accessible through the outer casing 18 and through which the fan assembly 100 can be operated. The fan assembly has a height, H, width, W, and depth, D, shown on FIGS. 1 and 3. The nozzle 1 is arranged to extend substantially orthogonally about the axis X. The height of the fan assembly, H, is perpendicular to the axis X and extends from the end of the base 16 remote from the nozzle 1 to the end of the nozzle 1 remote from the base 16. In this embodiment the fan assembly 100 has a height, H, of around 530 mm, but the fan assembly 100 may have any desired height. The base 16 and the nozzle 1 have a width, W, perpendicular to the height H and perpendicular to the axis X. The width of the base 16 is shown labelled W1 and the width of the nozzle 1 is shown labelled as W2 on FIG. 1. The base 16 and the nozzle 1 have a depth in the direction of the axis X. The depth of the base 16 is shown labelled D1 and the depth of the nozzle 1 is shown labelled as D2 on FIG. 3.

FIGS. 3, 4, 5 and 6 illustrate further specific details of the fan assembly 100. A motor 22 for creating an air flow through the nozzle 1 is located inside the base 16. The base 16 further comprises an air inlet 24*a*, 24*b* formed in the outer casing 18 and through which air is drawn into the base 16. A motor housing 28 for the motor 22 is also located inside the base 16. The motor 22 is supported by the motor housing 28 and held or fixed in a secure position within the base 16.

In the illustrated embodiment, the motor 22 is a DC brushless motor. An impeller 30 is connected to a rotary shaft extending outwardly from the motor 22, and a diffuser 32 is positioned downstream of the impeller 30. The diffuser 32 comprises a fixed, stationary disc having spiral blades.

An inlet 34 to the impeller 30 communicates with the air inlet 24*a*, 24*b* formed in the outer casing 18 of the base 16. The outlet 36 of the diffuser 32 and the exhaust from the impeller 30 communicate with hollow passageway portions or ducts located inside the base 16 in order to establish air flow from the impeller 30 to the interior passage 10 of the nozzle 1. The motor 22 is connected to an electrical connection and power supply and is controlled by a controller (not shown). Communication between the controller and the plurality of selection buttons 20 enables a user to operate the fan assembly 100.

The features of the nozzle 1 will now be described with reference to FIGS. 3, 4 and 5. The shape of the nozzle 1 is annular. In this embodiment the nozzle 1 has a diameter of around 350 mm, but the nozzle may have any desired diameter, for example around 300 mm The interior passage 10 is annular and is formed as a continuous loop or duct within the nozzle 1. The nozzle 1 comprises a wall 38 defining the interior passage 10 and the mouth 12. In the illustrated embodiments the wall 38 comprises two curved wall parts 38*a* and 38*b* connected together, and hereafter collectively referred to as the wall 38. The wall 38 comprises an inner surface 39 and an outer surface 40. In the illustrated embodiments the wall 38 is arranged in a looped or folded shape such that the inner surface 39 and outer surface 40 approach and partially face, or overlap, one another. The facing portions of the inner surface 39 and the outer surface 40 define the mouth 12. The mouth 12 extends about the axis X and comprises a tapered region 42 narrowing to an outlet 44.

The wall 38 is stressed and held under tension with a preload force such that one of the facing portions of the inner surface 39 and the outer surface 40 is biased towards the other; in the preferred embodiments the outer surface 40 is biased towards the inner surface 39. These facing portions of the inner surface 39 and the outer surface 40 are held apart by spacers. In the illustrated embodiments the spacers comprise a plurality of spacers 26 which are preferably equally angularly spaced about the axis X. The spacers 26 are preferably integral with the wall 38 and are preferably located on the inner surface 39 of the wall 38 so as to contact the outer surface 40 and maintain a substantially constant spacing about the axis X between the facing portions of the inner surface 39 and the outer surface 40 at the outlet 44 of the mouth 12.

Figure 4:
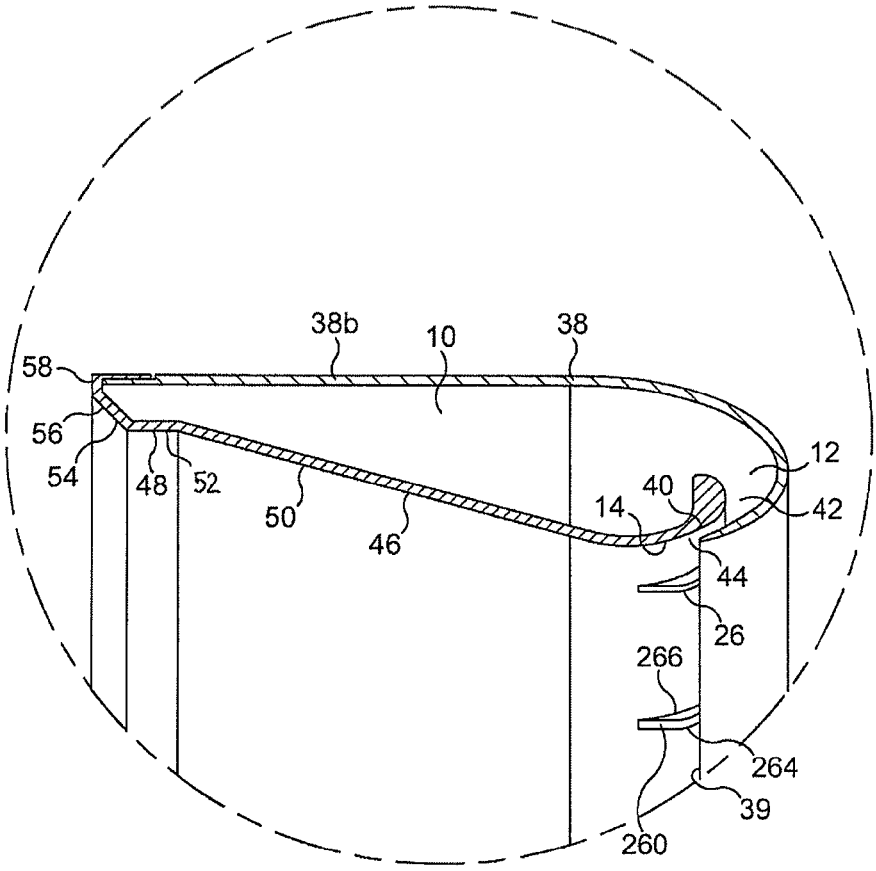
FIG. 4 is an enlarged side sectional detail of a portion of the fan assembly of FIG. 1.
Figure 5:
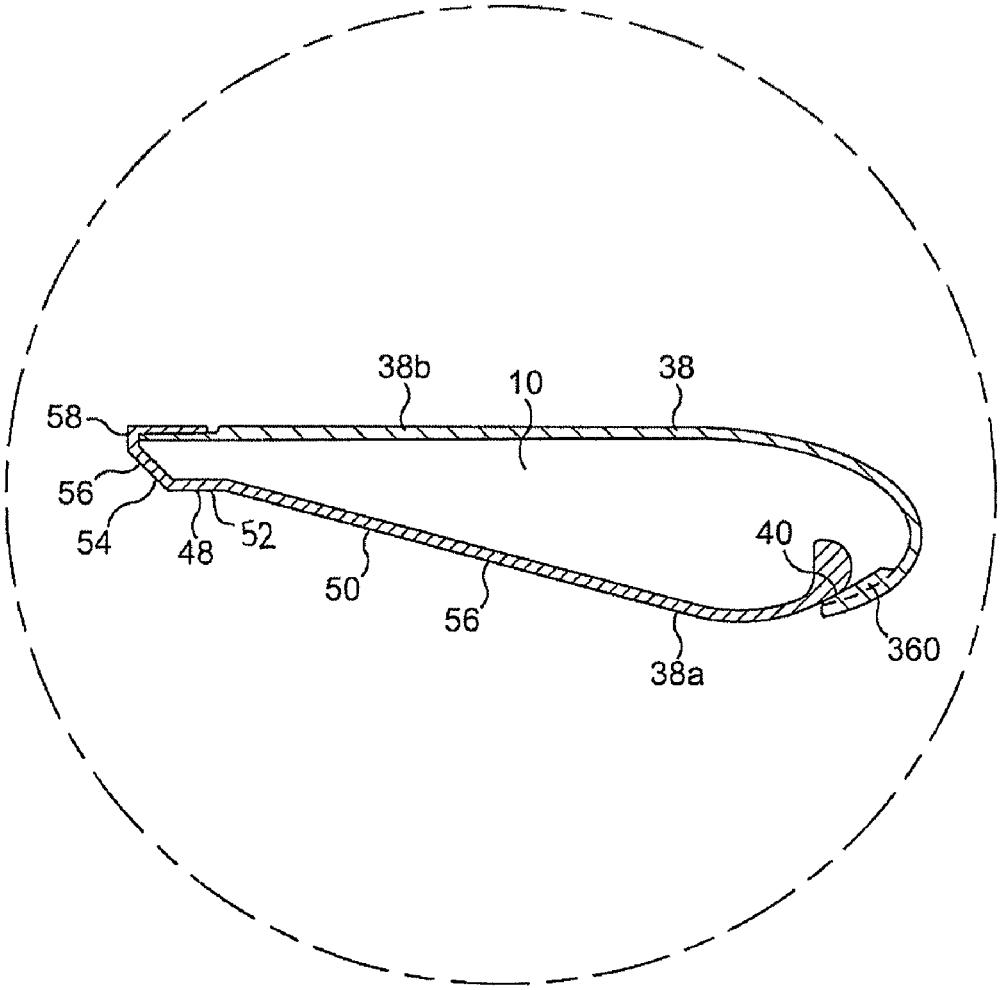
FIG. 5 is an alternative arrangement shown as an enlarged side sectional detail of a portion of the fan assembly of FIG. 1.
Figure 6:
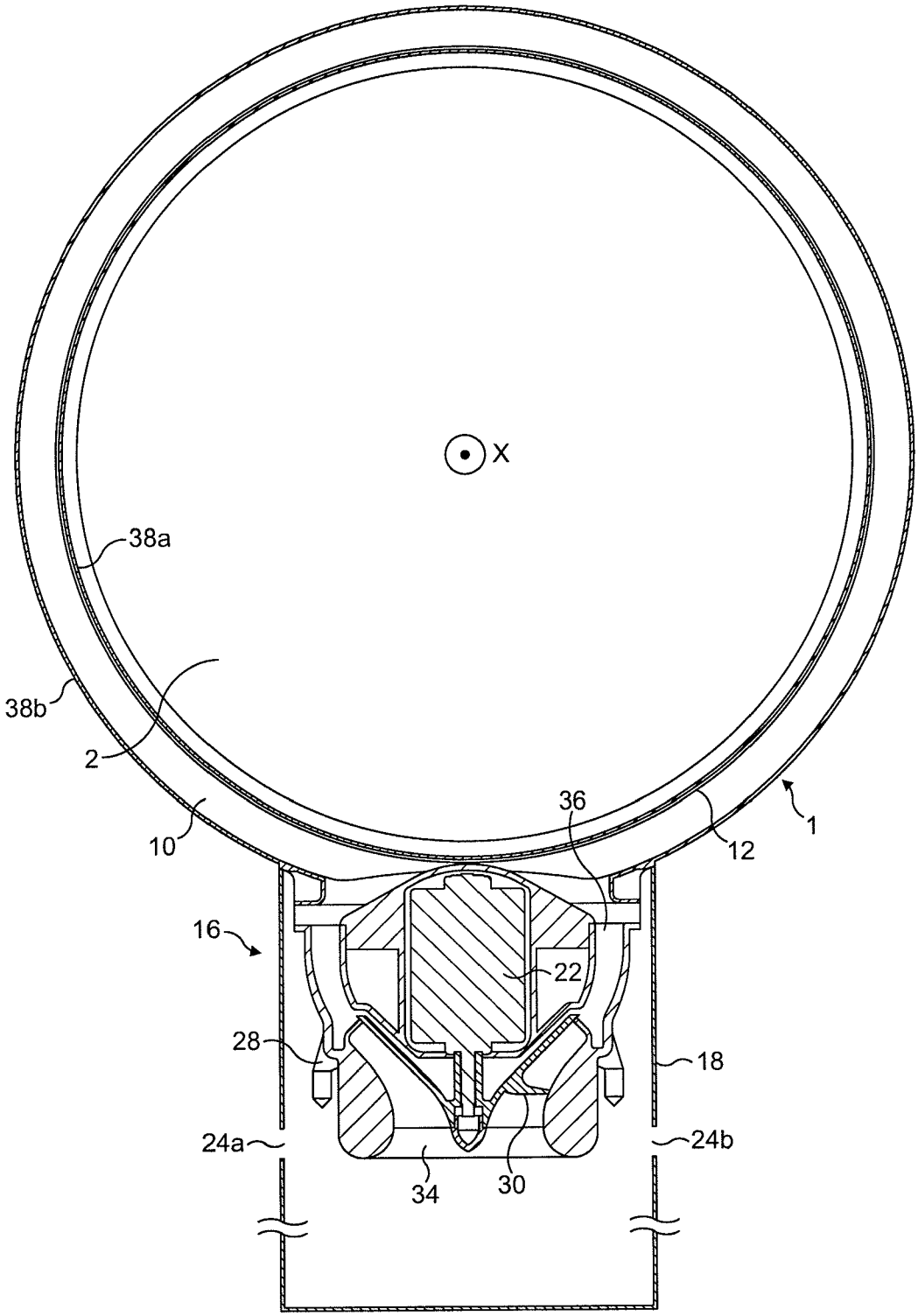
FIG. 6 is a sectional view of the fan assembly taken along line B-B of FIG. 3 and viewed from direction F of FIG. 3.

FIGS. 4 and 5 illustrate two alternative arrangements for the spacers 26. The spacers 26 illustrated in FIG. 4 comprise a plurality of fingers 260 each having an inner edge 264 and an outer edge 266. Each finger 260 is located between the facing portions of the inner surface 39 and the outer surface 40 of the wall 38. Each finger 260 is secured at its inner edge 264 to the inner surface 39 of the wall 38. A portion of the arm 260 extends beyond the outlet 44. The outer edge 266 of arm 260 engages the outer surface 40 of the wall 38 to space apart the facing portions of the inner surface 39 and the outer surface 40.

The spacers illustrated in FIG. 5 are similar to those illustrated in FIG. 4, except that the fingers 360 of FIG. 5 terminate substantially flush with the outlet 44 of the mouth 12.

The size of the fingers 260, 360 determines the spacing between the facing portions of the inner surface 39 and the outer surface 40.

The spacing between the facing portions at the outlet 44 of the mouth 12 is chosen to be in the range from 0.5 mm to 10 mm. The choice of spacing will depend on the desired performance characteristics of the fan. In this embodiment the outlet 44 is around 1.3 mm wide, and the mouth 12 and the outlet 44 are concentric with the interior passage 10.

The mouth 12 is adjacent a surface comprising a Coanda surface 14. The surface of the nozzle 1 of the illustrated embodiment further comprises a diffuser portion 46 located downstream of the Coanda surface 14 and a guide portion 48 located downstream of the diffuser portion 46. The diffuser portion 46 comprises a diffuser surface 50 arranged to taper away from the axis X in such a way so as to assist the flow of air current delivered or output from the fan assembly 100. In the example illustrated in FIG. 3 the mouth 12 and the overall arrangement of the nozzle 1 is such that the angle subtended between the diffuser surface 50 and the axis X is around 15°. The angle is chosen for efficient air flow over the Coanda surface 14 and over the diffuser portion 46. The guide portion 48 includes a guide surface 52 arranged at an angle to the diffuser surface 50 in order to further aid efficient delivery of cooling air flow to a user. In the illustrated embodiment the guide surface 52 is arranged substantially parallel to the axis X and presents a substantially flat and substantially smooth face to the air flow emitted from the mouth 12.

The surface of the nozzle 1 of the illustrated embodiment terminates at an outwardly flared surface 54 located downstream of the guide portion 48 and remote from the mouth 12. The flared surface 54 comprises a tapering portion 56 and a tip 58 defining the circular opening 2 from which air flow is emitted and projected from the fan assembly 1. The tapering portion 56 is arranged to taper away from the axis X in a manner such that the angle subtended between the tapering portion 56 and the axis is around 45°. The tapering portion 56 is arranged at an angle to the axis which is steeper than the angle subtended between the diffuser surface 50 and the axis. A sleek, tapered visual effect is achieved by the tapering portion 56 of the flared surface 54. The shape and blend of the flared surface 54 detracts from the relatively thick section of the nozzle 1 comprising the diffuser portion 46 and the guide portion 48. The user's eye is guided and led, by the tapering portion 56, in a direction outwards and away from axis X towards the tip 58. By this arrangement the appearance is of a fine, light, uncluttered design often favoured by users or customers.

The nozzle 1 extends by a distance of around 5 cm in the direction of the axis. The diffuser portion 46 and the overall profile of the nozzle 1 are based, in part, on an aerofoil shape. In the example shown the diffuser portion 46 extends by a distance of around two thirds the overall depth of the nozzle 1 and the guide portion 48 extends by a distance of around one sixth the overall depth of the nozzle.

The fan assembly 100 described above operates in the following manner. When a user makes a suitable selection from the plurality of buttons 20 to operate or activate the fan assembly 100, a signal or other communication is sent to drive the motor 22. The motor 22 is thus activated and air is drawn into the fan assembly 100 via the air inlets 24*a*, 24*b*. In the preferred embodiment air is drawn in at a rate of approximately 20 to 30 litres per second, preferably around 27 l/s (litres per second). The air passes through the outer casing 18 and along the route illustrated by arrow F' of FIG. 3 to the inlet 34 of the impeller 30. The air flow leaving the outlet 36 of the diffuser 32 and the exhaust of the impeller 30 is divided into two air flows that proceed in opposite directions through the interior passage 10. The air flow is constricted as it enters the mouth 12, is channelled around and past spacers 26 and is further constricted at the outlet 44 of the mouth 12. The constriction creates pressure in the system. The motor 22 creates an air flow through the nozzle 16 having a pressure of at least 400 kPa. The air flow created overcomes the pressure created by the constriction and the air flow exits through the outlet 44 as a primary air flow.

The output and emission of the primary air flow creates a low pressure area at the air inlets 24*a*, 24*b* with the effect of drawing additional air into the fan assembly 100. The operation of the fan assembly 100 induces high air flow through the nozzle 1 and out through the opening 2. The primary air flow is directed over the Coanda surface 14, the diffuser surface 50 and the guide surface 52. The primary air flow is amplified by the Coanda effect and concentrated or focussed towards the user by the guide portion 48 and the angular arrangement of the guide surface 52 to the diffuser surface 50. A secondary air flow is generated by entrainment of air from the external environment, specifically from the region around the outlet 44 and from around the outer edge of the nozzle 1. A portion of the secondary air flow entrained by the primary air flow may also be guided over the diffuser surface 48. This secondary air flow passes through the opening 2, where it combines with the primary air flow to produce a total air flow projected forward from the nozzle 1.

The combination of entrainment and amplification results in a total air flow from the opening 2 of the fan assembly 100 that is greater than the air flow output from a fan assembly without such a Coanda or amplification surface adjacent the emission area.

The distribution and movement of the air flow over the diffuser portion 46 will now be described in terms of the fluid dynamics at the surface.

In general a diffuser functions to slow down the mean speed of a fluid, such as air, this is achieved by moving the air over an area or through a volume of controlled expansion. The divergent passageway or structure forming the space through which the fluid moves must allow the expansion or divergence experienced by the fluid to occur gradually. A harsh or rapid divergence will cause the air flow to be disrupted, causing vortices to form in the region of expansion. In this instance the air flow may become separated from the expansion surface and uneven flow will be generated. Vortices lead to an increase in turbulence, and associated noise, in the air flow which can be undesirable, particularly in a domestic product such as a fan.

In order to achieve a gradual divergence and gradually convert high speed air into lower speed air the diffuser can be geometrically divergent. In the arrangement described above, the structure of the diffuser portion 46 results in an avoidance of turbulence and vortex generation in the fan assembly.

The air flow passing over the diffuser surface 50 and beyond the diffuser portion 46 can tend to continue to diverge as it did through the passageway created by the diffuser portion 46. The influence of the guide portion 48 on the air flow is such that the air flow emitted or output from the fan opening is concentrated or focussed towards user or into a room. The net result is an improved cooling effect at the user.

The combination of air flow amplification with the smooth divergence and concentration provided by the diffuser portion 46 and guide portion 48 results in a smooth, less turbulent output than that output from a fan assembly without such a diffuser portion 46 and guide portion 48.

The amplification and laminar type of air flow produced results in a sustained flow of air being directed towards a user from the nozzle 1. In the preferred embodiment the mass flow rate of air projected from the fan assembly 100 is at least 450 l/s, preferably in the range from 600 l/s to 700 l/s. The flow rate at a distance of up to 3 nozzle diameters (i.e. around 1000 to 1200 mm) from a user is around 400 to 500 l/s. The total air flow has a velocity of around 3 to 4 m/s (metres per second). Higher velocities are achievable by reducing the angle subtended between the surface and the axis X. A smaller angle results in the total air flow being emitted in a more focussed and directed manner. This type of air flow tends to be emitted at a higher velocity but with a reduced mass flow rate. Conversely, greater mass flow can be achieved by increasing the angle between the surface and the axis. In this case the velocity of the emitted air flow is reduced but the mass flow generated increases. Thus the performance of the fan assembly can be altered by altering the angle subtended between the surface and the axis X.

The invention is not limited to the detailed description given above. Variations will be apparent to the person skilled in the art. For example, the fan could be of a different height or diameter. The base and the nozzle of the fan could be of a different depth, width and height. The fan need not be located on a desk, but could be free standing, wall mounted or ceiling mounted. The fan shape could be adapted to suit any kind of situation or location where a cooling flow of air is desired. A portable fan could have a smaller nozzle, say 5 cm in diameter. The device for creating an air flow through the nozzle can be a motor or other air emitting device, such as any air blower or vacuum source that can be used so that the fan assembly can create an air current in a room. Examples include a motor such as an AC induction motor or types of DC brushless motor, but may also comprise any suitable air movement or air transport device such as a pump or other device for providing directed fluid flow to generate and create an air flow. Features of a motor may include a diffuser or a secondary diffuser located downstream of the motor to recover some of the static pressure lost in the motor housing and through the motor.

The outlet of the mouth may be modified. The outlet of the mouth may be widened or narrowed to a variety of spacings to maximise air flow. The spacers or spacers may be of any size or shape as required for the size of the outlet of the mouth. The spacers may include shaped portions for sound and noise reduction or delivery. The outlet of the mouth may have a uniform spacing, alternatively the spacing may vary around the nozzle. There may be a plurality of spacers, each having a uniform size and shape, alternatively each spacer, or any number of spacers, may be of different shapes and dimensions. The spacers may be integral with a surface of the nozzle or may be manufactured as one or more individual parts and secured to the nozzle or surface of the nozzle by gluing or by fixings such as bolts or screws or snap fastenings, other suitable fixing means may be used. The spacers may be located at the mouth of the nozzle, as described above, or may be located upstream of the mouth of the nozzle. The spacers may be manufactured from any suitable material, such as a plastic, resin or a metal.

The air flow emitted by the mouth may pass over a surface, such as Coanda surface, alternatively the airflow may be emitted through the mouth and be projected forward from the fan assembly without passing over an adjacent surface. The Coanda effect may be made to occur over a number of different surfaces, or a number of internal or external designs may be used in combination to achieve the flow and entrainment required. The diffuser portion may be comprised of a variety of diffuser lengths and structures. The guide portion may be a variety of lengths and be arranged at a number of different positions and orientations to as required for different fan requirements and different types of fan performance. The effect of directing or concentrating the effect of the airflow can be achieved in a number of different ways; for example the guide portion may have a shaped surface or be angled away from or towards the centre of the nozzle and the axis X.

Other shapes of nozzle are envisaged. For example, a nozzle comprising an oval, or 'racetrack' shape, a single strip or line, or block shape could be used. The fan assembly provides access to the central part of the fan as there are no blades. This means that additional features such as lighting or a clock or LCD display could be provided in the opening defined by the nozzle.

Other features could include a pivotable or tiltable base for ease of movement and adjustment of the position of the nozzle for the user.

The invention claimed is:

1. A bladeless fan assembly for creating an air current, the fan assembly comprising a nozzle mounted on a base for creating an air flow through the nozzle, the nozzle comprising an interior passage for receiving the air flow from the base, a mouth through which the air flow is emitted, the mouth being defined by first and second facing surfaces of the nozzle, and a plurality of spacers for spacing apart the facing surfaces of the nozzle, the nozzle defining an opening through which air from outside the fan assembly is drawn by the air flow emitted from the mouth, wherein the spacers are integral with the first facing surface, one of the facing surfaces of the nozzle is biased towards the other of the facing surfaces so that the spacers contact the second facing surface to space apart the facing surfaces, and the biasing occurs independently of the spacers.

2. The fan assembly of claim 1, wherein the nozzle extends about an axis to define said opening, and wherein the spacers are angularly spaced about said axis, preferably equally angularly spaced about said axis.

3. The fan assembly of claim 2, wherein the nozzle extends substantially cylindrically about the axis.

4. The fan assembly of claim 2, wherein the nozzle extends by a distance of at least 5 cm in the direction of the axis.

5. The fan assembly of claim 2, wherein the nozzle extends about the axis by a distance in the range from 30 cm to 180 cm.

6. The fan assembly of claim 1, wherein the number of spacers is in the range of 5 to 50.

7. The fan assembly of claim 1, wherein the nozzle comprises a loop.

8. The fan assembly of claim 1, wherein the nozzle is substantially annular.

9. The fan assembly of claim 1, wherein the nozzle is at least partially circular.

10. The fan assembly of claim 1, wherein the nozzle comprises at least one wall defining the interior passage and the mouth, and wherein said at least one wall comprises the facing surfaces defining the mouth.

11. The fan assembly of claim 1, wherein the mouth has an outlet, and the spacing between the facing surfaces at the outlet of the mouth is in the range from 0.5 mm to 10 mm.

12. The fan assembly of claim 1, wherein the base comprises an impeller driven by a motor.

13. The fan assembly of claim 12, wherein the base comprises a DC brushless motor and a mixed flow impeller.

14. A nozzle for a bladeless fan assembly for creating an air current, the nozzle comprising an interior passage for receiving an air flow, a mouth through which the air flow is emitted, the mouth being defined by first and second facing surfaces of the nozzle, and a plurality of spacers for spacing apart the facing surfaces of the nozzle, the nozzle defining an opening through which air from outside the fan assembly is drawn by the air flow emitted from the mouth, wherein the spacers are integral with the first facing surface, one of the facing surfaces of the nozzle is biased towards the other of the facing surfaces so that the spacers contact the second facing surface to space apart the spacing surfaces, and the biasing occurs independently of the spacers.

15. The nozzle of claim 14, wherein the nozzle comprises a Coanda surface located adjacent the mouth and over which the mouth is arranged to direct the air flow.

16. The nozzle of claim 15, wherein the nozzle comprises a diffuser located downstream of the Coanda surface.

17. The nozzle of claim 14, wherein the nozzle extends about an axis to define said opening, and wherein the plurality of spacers are angularly spaced about said axis, preferably equally angularly spaced about said axis.

18. The nozzle of claim 17, wherein the nozzle extends substantially cylindrically about the axis.

19. The nozzle of claim 17, wherein the nozzle extends by a distance of at least 5 cm in the direction of the axis.

20. The nozzle of claim 17, wherein the nozzle extends about the axis by a distance in the range from 30 cm to 180 cm.

21. The nozzle of claim 14 or 15, wherein the plurality of spacers comprises between 5 to 50 spacers.

22. The nozzle of claim 14 or 15, wherein the nozzle comprises a loop.

23. The nozzle of claim 14 or 15, wherein the nozzle is substantially annular.

24. The nozzle of claim 14 or 15, wherein the nozzle is at least partially circular.

25. The nozzle of claim 14 or 15, wherein the nozzle comprises at least one wall defining the interior passage and the mouth, and wherein said at least one wall comprises the facing surfaces defining the mouth.

26. The nozzle of claim 14 or 15, wherein the mouth has an outlet, and the spacing between the facing surfaces at the outlet of the mouth is in the range from 0.5 mm to 10 mm.

* * * * *